US009455077B2

(12) United States Patent
Jung

(10) Patent No.: US 9,455,077 B2
(45) Date of Patent: Sep. 27, 2016

(54) NOISE REDUCTION TYPE SOLENOID VALVE

(71) Applicant: HYUNDAI MOBIS CO., LTD., Seoul (KR)

(72) Inventor: Jae Woo Jung, Daegu (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 14/686,594

(22) Filed: Apr. 14, 2015

(65) Prior Publication Data

US 2016/0148737 A1 May 26, 2016

(30) Foreign Application Priority Data

Nov. 24, 2014 (KR) ..... 10-2014-0164271

(51) Int. Cl.
*H01F 7/16* (2006.01)

(52) U.S. Cl.
CPC ..... *H01F 7/1607* (2013.01); *H01F 2007/1692* (2013.01)

(58) Field of Classification Search
CPC ..... H01F 2007/1692
See application file for complete search history.

(56) References Cited

U.S. PATENT DOCUMENTS 3,728,654 A * 4/1973 Tada ..... H01F 7/1615 335/234
3,743,898 A * 7/1973 Sturman ..... F02D 41/20 335/254
3,895,331 A * 7/1975 Saarem ..... F16K 31/0679 335/171

FOREIGN PATENT DOCUMENTS

DE 4208367 A1 * 9/1993 ..... H01F 7/1607
JP EP 0174808 A1 * 3/1986 ..... H01F 7/1607
JP 05-267065 A 10/1993
JP 2007-67280 A 3/2007
KR 10-2012-0032272 A 4/2012
KR 10-1193468 B1 10/2012
WO WO 2009126188 A2 * 10/2009 ..... H01F 7/1615

OTHER PUBLICATIONS

Decision of Rejection dated Mar. 22, 2016 of corresponding Korean Patent Application No. 10-2014-0164271—4 pages.

* cited by examiner

*Primary Examiner* — Mohamad Musleh
(74) *Attorney, Agent, or Firm* — Knobbe Martens Olson & Bear LLP

(57) ABSTRACT

A noise reduction type solenoid valve may include: a plunger moved in a linear direction; a bobbin installed so as to surround the plunger; a partition part protruding to the outside of the bobbin, and forming a plurality of divided spaces along a longitudinal direction of the bobbin; and a coil part wound in each of the divided spaces with the partition part interposed therebetween.

8 Claims, 6 Drawing Sheets

NOISE REDUCTION TYPE SOLENOID VALVE

CROSS-REFERENCES TO RELATED APPLICATIONS

The present application claims priority to Korean application number 10-2014-0164271, filed on Nov. 24, 2014, which is incorporated by reference in its entirety.

BACKGROUND

The present disclosure relates to a noise reduction type solenoid valve, and more particularly, to a noise reduction type solenoid valve capable of reducing electromagnetic noise which occurs when a solenoid is operated.

In general, a solenoid valve refers to a device which converts electrical energy into mechanical energy, that is, a linear motion. The solenoid valve includes a bobbin formed outside a plunger, and a coil is wound around the bobbin. The bobbin has a hole formed in a vertical direction, and the coil is stacked on the outside of the bobbin.

As soon as power is applied to the solenoid valve, the coil is magnetized. Then, as the bobbin operates as an electromagnet, the plunger formed in the bobbin is moved in the vertical direction.

The related art is disclosed in Korean Patent Laid-open Publication No. 2012-0032272 published on Apr. 5, 2012 and entitled "Solenoid valve for reducing noise".

SUMMARY

Embodiments of the present invention are directed to a noise reduction type solenoid valve capable of reducing electromagnetic noise which occurs when a solenoid is operated.

In one embodiment, a noise reduction type solenoid valve may include: a plunger moved in a linear direction; a bobbin installed so as to surround the plunger; a partition part protruding to the outside of the bobbin, and forming a plurality of divided spaces along a longitudinal direction of the bobbin; and a coil part wound in each of the divided spaces with the partition part interposed therebetween.

The bobbin and the partition part may be integrated with each other.

The partition part may include: a first partition extended in a lateral direction from the top of the bobbin; a second partition extended in the lateral direction from the bottom of the bobbin, while facing the first partition; and an inner partition positioned between the first and second partitions, and extended in the lateral direction from the body of the bobbin.

The first partition may be positioned at the top of the coil part so as to restrict upward movement of the coil part, and the second partition may be positioned at the bottom of the coil part so as to restrict downward movement of the coil part.

The inner partition may be formed in a hollow disk shape.

The coil part may be wound in the first space of the divided spaces facing the first partition, and then wound in the second space divided from the first space by the inner partition.

The coil part may be sequentially stacked toward the outside from the inside of the first space facing the bobbin, then connected to the inside of the second space facing the bobbin, and stacked toward the outside from the inside of the second space.

The divided spaces may include a first space positioned between the first partition and the inner partition and a second space positioned between the inner partition and the second partition.

The coil part may include: a first coil wound in the first space; and a second coil wound in the second space, and the tail of the first coil may be connected to the head of the second coil.

The first coil may be wound around the outside of the bobbin at the inside of the first space facing the bobbin, and stacked toward the outside of the first space.

A first winding of the first coil may be started from the top of the first space and finished at the bottom of the first space facing the inner partition, while the first coil is wound in a spiral shape toward the bottom of the first space, and a second winding connected to the bottom of the first winding in the first coil may be started from the bottom of the first space, while the first coil is wound in a spiral shape toward the top of the first space.

A first winding of the second coil may be started from the top of the second space and finished at the bottom of the second space facing the second partition, while the second coil is wound in a spiral shape toward the bottom of the second space, and a second winding connected to the bottom of the first winding in the second coil may be started from the bottom of the second space, while the second coil is wound in a spiral shape toward the top of the second space.

DESCRIPTION OF EMBODIMENTS

Hereafter, a noise reduction type solenoid valve in accordance with an embodiment of the invention will be described in detail with reference to the accompanying drawings. For convenience of description, a noise reduction type solenoid valve applied to a solenoid valve which includes a plunger moving in a vertical direction will be taken as an example for description. It should be noted that the drawings are not to precise scale and may be exaggerated in thickness of lines or sizes of components for descriptive convenience and clarity only.

Furthermore, the terms as used herein are defined by taking functions of the invention into account and can be changed according to the custom or intention of users or operators. Therefore, definition of the terms should be made according to the overall disclosures set forth herein.

In a solenoid valve, when electricity is transmitted through the coil of the solenoid valve, an electric force may be generated in proportion to a potential difference of the electricity transmitted through the coil, and then vibrate the coil. The vibration of the coil may cause electromagnetic noise.

Figure 1:
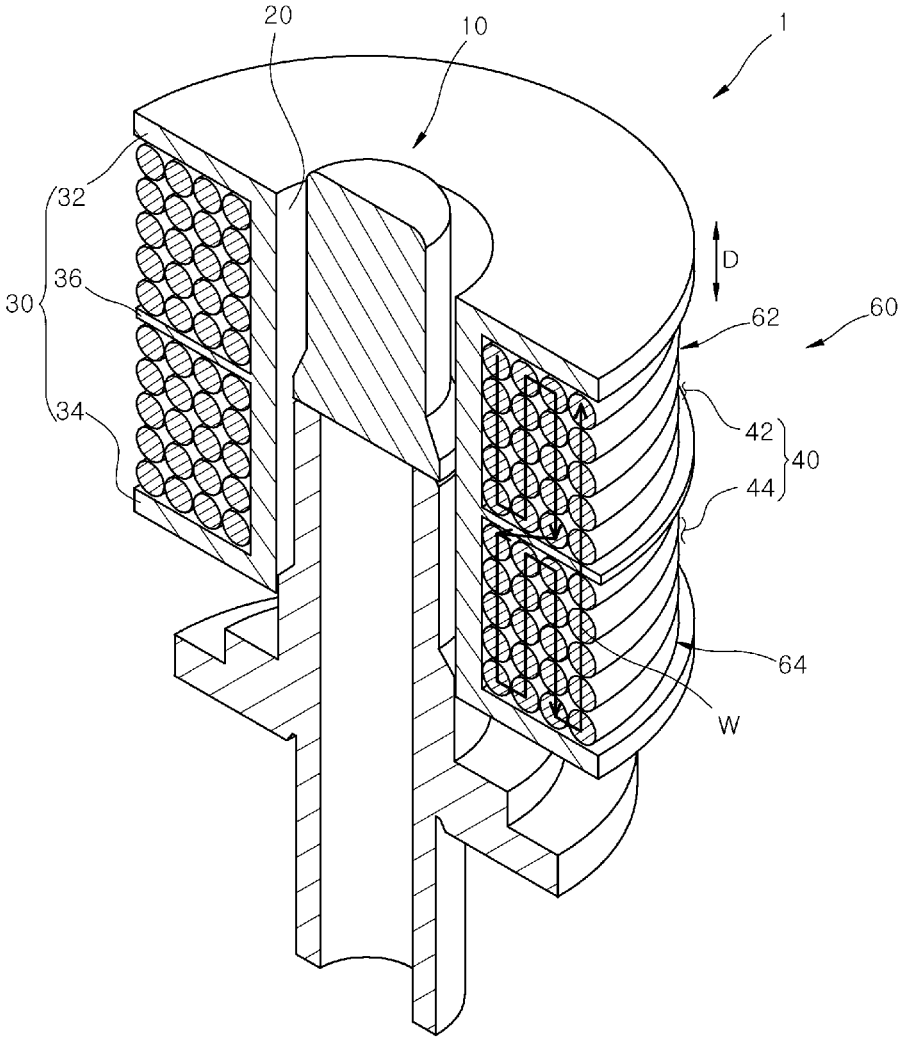
FIG. 1 is a perspective view schematically illustrating the structure of a noise reduction type solenoid valve in accordance with an embodiment of the present invention.
Figure 2:
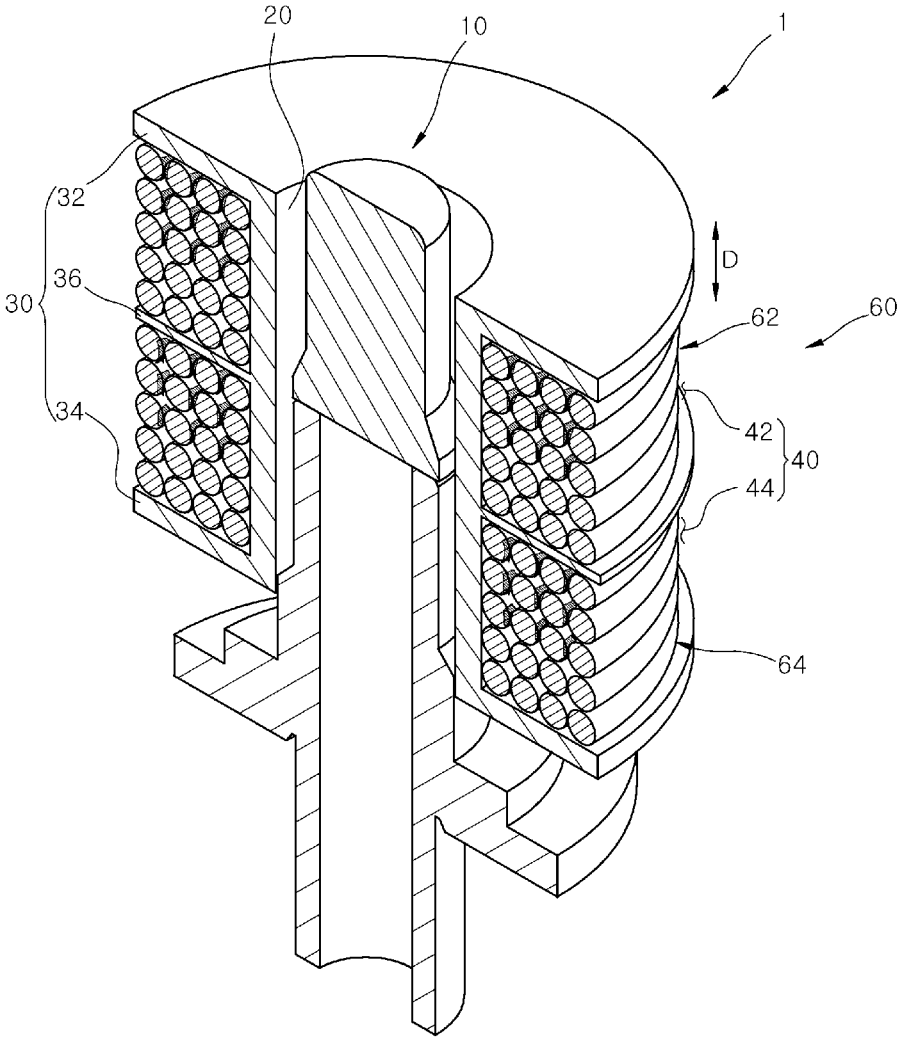
FIG. 2 is a perspective view schematically illustrating portions in which an electric force is concentrated in the noise reduction type solenoid valve in accordance with the embodiment of the present invention.
Figure 3:
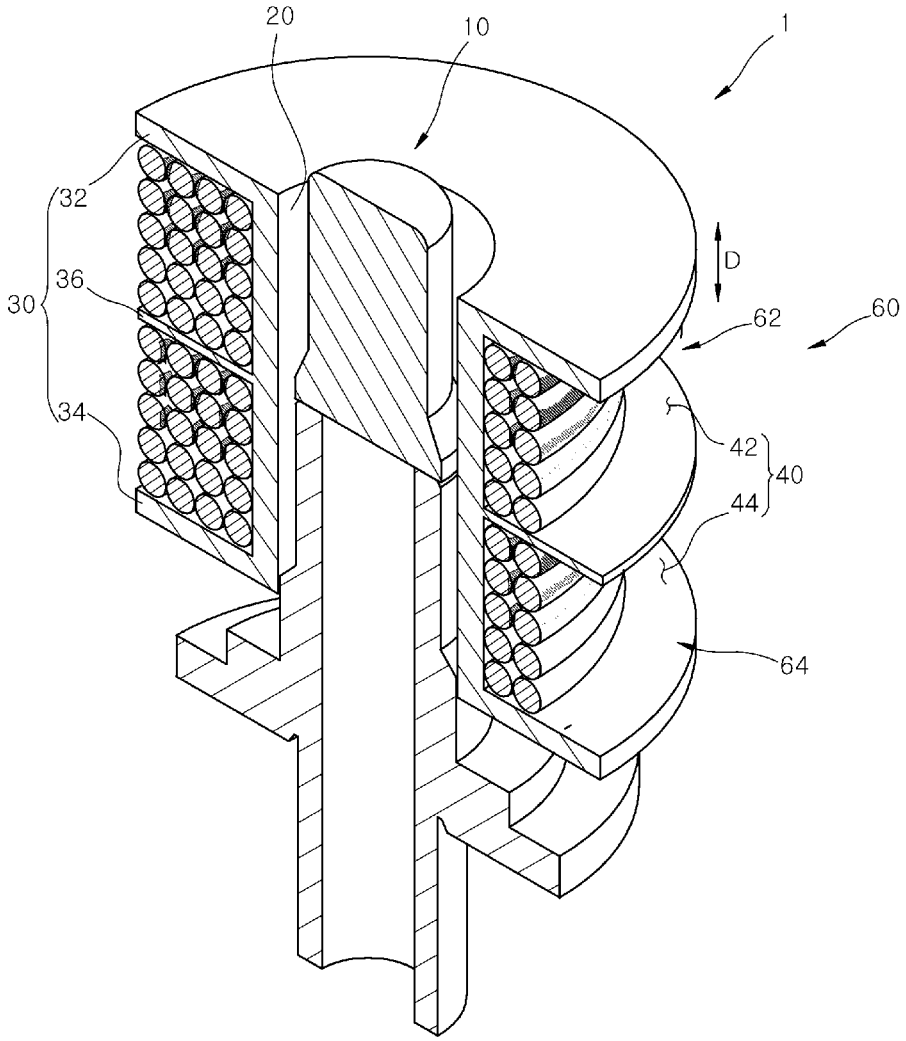
FIG. 3 is a perspective view schematically illustrating the portions in which an electric force is concentrated in a state where a part of a coil part is removed in the noise reduction type solenoid valve in accordance with the embodiment of the present invention.
Figure 4:
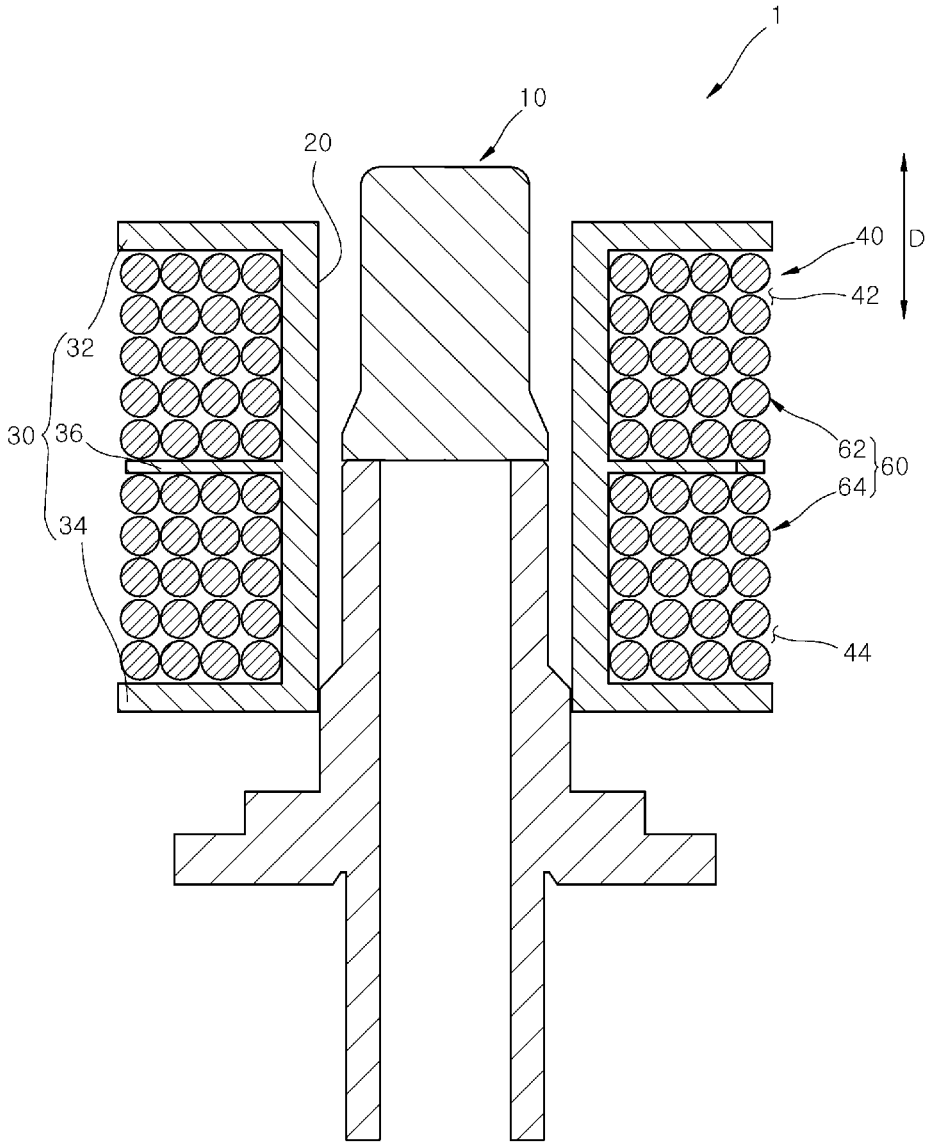
FIG. 4 is a cross-sectional view schematically illustrating the structure of the noise reduction type solenoid valve in accordance with the embodiment of the present invention.

FIG. 1 is a perspective view schematically illustrating the structure of a noise reduction type solenoid valve in accordance with an embodiment of the present invention. FIG. 2 is a perspective view schematically illustrating portions in which an electric force is concentrated in the noise reduction type solenoid valve in accordance with the embodiment of the present invention. FIG. 3 is a perspective view schematically illustrating the portions in which an electric force is concentrated in a state where a part of a coil part is removed in the noise reduction type solenoid valve in accordance with the embodiment of the present invention. FIG. 4 is a cross-sectional view schematically illustrating the structure of the noise reduction type solenoid valve in accordance with the embodiment of the present invention.

As illustrated in FIGS. 1 and 4, the noise reduction type solenoid valve 1 in accordance with the embodiment of the present invention may include a plunger 10, a bobbin 20, a partition part 30, and a coil part 60. The plunger 10 may be moved in a linear direction. The bobbin 20 may be installed to cover the plunger 10. The partition part 30 may protrude to the outside of the bobbin 20, and form a plurality of divided spaces 40 along the longitudinal direction D of the bobbin 20. The coil part 60 may be wound in the divided spaces 40 with the partition part 30 provided therebetween.

The plunger 10 may be moved in a vertical line direction, and positioned in the bobbin 20. The bobbin 20 may be installed so as to cover the plunger 10, and have the coil part 60 wound around the outside thereof.

The partition part 30 may be formed in various shapes, as long as the partition part 30 protrudes to the outside of the bobbin 20 and forms the plurality of divided spaces 40 along the longitudinal direction D of the bobbin 20. The partition part 30 in accordance with the embodiment of the present invention may be integrated with the bobbin 20, and include a first partition 32, a second partition 34, and an inner partition 36. Since the partition part 30 is integrated with the bobbin 20, a winding pattern of the coil part 60 may be adjusted to reduce electromagnetic noise, without a separate additional part.

The first partition 32 may be extended in the lateral direction (horizontal direction in FIG. 1) from the top of the bobbin 20 (based on FIG. 1). The second partition 34 may be extended in the lateral direction from the bottom of the bobbin 20, while facing the first partition 32. The inner partition 36 may be positioned between the first and second partitions 32 and 34, and extended in the lateral direction from the body of the bobbin 20.

The first partition 32 may be positioned at the top of the coil part 60 so as to restrict the upward movement of the coil part 60, and the second partition 34 may be positioned at the bottom of the coil part 60 so as to restrict the downward movement of the coil part 60. The divided spaces 40 may be formed by the inner partition 36 positioned between the first and second partitions 32 and 34.

In the present embodiment, only one inner partition 36 is installed between the first and second partitions 32 and 34. However, this is only an example, and two or more inner partitions 36 may be installed, if necessary.

The first and second partitions 32 and 34 and the inner partition 36 may be formed in a hollow disk shape. The first and second partitions 32 and 34 and the inner partition 36 may be modified into various shapes, as long as the first and second partitions 32 and 34 and the inner partition 36 can divide the space in which the coil part 60 is wound.

As the partition part 30 is provided outside the bobbin 20, the plurality of divided spaces 40 in which the coil part 60 is wound may be formed. The divided spaces 40 in accordance with the embodiment of the present invention may include a first space 42 positioned between the first partition 32 and the inner partition 36 and a second space 44 positioned between the inner partition 36 and the second partition 34.

The second space 44 may be positioned under the first space 42, and the coil part 60 may be wound in each of the first and second spaces 42 and 44.

The coil part 60 may be formed in various shapes, as long as the coil part 60 can be wound in each of the divided spaces 40 with the partition part 30 provided therebetween. The coil part 60 in accordance with the embodiment of the present invention may be wound in the first space 42 of the divided spaces 40, facing the first partition 32, and then wound in the second space 44 which is divided from the first space 42 by the inner partition 36. The coil part 60 in accordance with the embodiment of the present invention may include a first coil 62 wound in the first space 42 and a second coil 64 wound in the second space 44.

The coil part 60 may be sequentially stacked toward the outside from the inside of the first space 42, facing the bobbin 20. Then, the coil part 60 may be connected to the inside of the second space 44, facing the bobbin 20, and stacked toward the outside from the inside of the second space 44, in order to reduce electromagnetic noise.

The tail of the first coil 62 may be connected to the head of the second coil 64. Furthermore, the first coil 62 may be stacked toward the outside of the first space 42, while being wound around the outside of the bobbin 20 at the inside of the first space 42, facing the bobbin 20. As indicated by W in FIG. 1, electricity transmitted along the coil part 60 may be first passed through the first coil 62 and then transmitted along the second coil 64.

Referring to the transmission direction W of the electricity in FIG. 1, a first winding of the first coil 62 may be started from the top of the first space 42, and finished at the bottom of the first space 42, facing the inner partition 36, while the first coil 62 is wound in a spiral shape toward the bottom of the first space 42. Then, a second winding connected to the bottom of the first winding in the first coil 62 may be started from the bottom of the first space 42, and finished at the top of the first space 42, while the first coil 62 is wound in a spiral shape toward the top of the first space 42. That is, the first coil 62 may be wound in a zigzag direction from the inside of the first space 42 toward the outside of the first space 42.

Furthermore, a first winding of the second coil 64 may be started from the top of the second space 44, and finished at the bottom of the second space 44, facing the second partition 34, while the second coil 64 is wound in a spiral shape toward the bottom of the second space 44. Then, a second winding connected to the bottom of the first winding in the second coil 64 may be started from the bottom of the second space 44, and finished at the top of the second space 44, while the second coil 64 is wound in a spiral shape toward the top of the second space 44. That is, the second coil 64 may be wound in a zigzag direction from the inside of the second space 44 toward the outside of the second space 44.

The coil wound around the outside of the second coil 64 at the bottom of the second space 44 may be wound upward while being wound around the outside of the second coil 64 in the second space 44 and the outside of the first coil 62 in the first space 42.

When a voltage supplied to the first coil 62 is 13V, a voltage coming out of the first coil 62 is 8V, and when a voltage supplied to the second coil 64 is 7V, a voltage coming out of the second coil 64 is 2V. In a typical solenoid valve, however, although a voltage of 13V is supplied to a coil, only a voltage of 1V comes out of the coil. In the solenoid valve in accordance with the embodiment of the present invention, the first and second coils 62 and 64 wound around the first and second spaces 42 and 44 serving as the top and bottom layers, respectively, have a small potential difference formed therebetween. Thus, a small electric force may be formed.

According to the Coulomb's law, the electric force is inversely proportional to the square of a distance between two charges, and proportional to the product of two charges. Thus, the noise reduction type solenoid valve 1 in accordance with the embodiment of the present invention may form a smaller electric force than the typical solenoid valve.

As illustrated in FIGS. 2 and 3, a portion in which the distribution of electric forces is concentrated may be tested, after electricity is supplied to the noise reduction type solenoid valve 1 in accordance with the embodiment of the present invention. In this case, an electric force concentration 80 may be partially formed at the tops of the first and second coils 62 and 64, but the area of the electric force concentration 80 may be reduced more than in the typical solenoid valve. Thus, electromagnetic noise can be reduced. In the typical solenoid valve, the electric force concentration is the highest at the top of the boundary between different windings of the coil, and gradually decreases toward the bottom of the coil. However, the electric force concentration as a whole is higher than in the noise reduction type solenoid valve 1 in accordance with the embodiment of the present invention.

Hereafter, referring to the accompanying drawings, the operation of the noise reduction type solenoid valve in accordance with the embodiment of the present invention will be described in detail.

When a voltage is applied to the coil part 60 of the noise reduction type solenoid valve 1, a current may flow along the coil part 60. Since a voltage is the product of current and resistance, the current value flowing through the coil part 60 may be determined by the resistance of the coil part 60.

Thus, since the voltage flowing through the coil part 60 drops, an electric force may be generated by a potential difference between the first and second coils 62 and 64. The electric force generated by the noise reduction type solenoid valve 1 in accordance with the embodiment of the present invention may be smaller than in the typical solenoid valve. The electric force may vibrate the first and second coils 62 and 64. Due to the vibration of the coil part 60, caused by the electric force, electromagnetic noise may occur in the noise reduction type solenoid valve 1. However, since the electric force is smaller than in the typical solenoid valve, the sound pressure of the electromagnetic noise may be reduced more than in the typical solenoid valve.

In the noise reduction type solenoid valve 1 in accordance with the embodiment of the present invention, since the plurality of divided spaces 40 are formed outside the bobbin 20 and the coil part 60 is wound in each of the spaces, the electric force may be lowered to reduce electromagnetic noise. Thus, the noise reduction type solenoid valve 1 can reduce a noise source, because the electric force concentration 80 is distributed only in a part of the coil part 60. Furthermore, the winding pattern of the coil part 60 may be adjusted to reduce electromagnetic noise, without a separate structure.

Hereafter, a noise reduction type solenoid valve 3 in accordance with another embodiment of the present invention will be described with reference to the drawings.

For convenience of description, components having the same structure and operation as those of the above-described embodiment will be represented by like reference numerals, and the detailed descriptions thereof are omitted herein.

Figure 5:
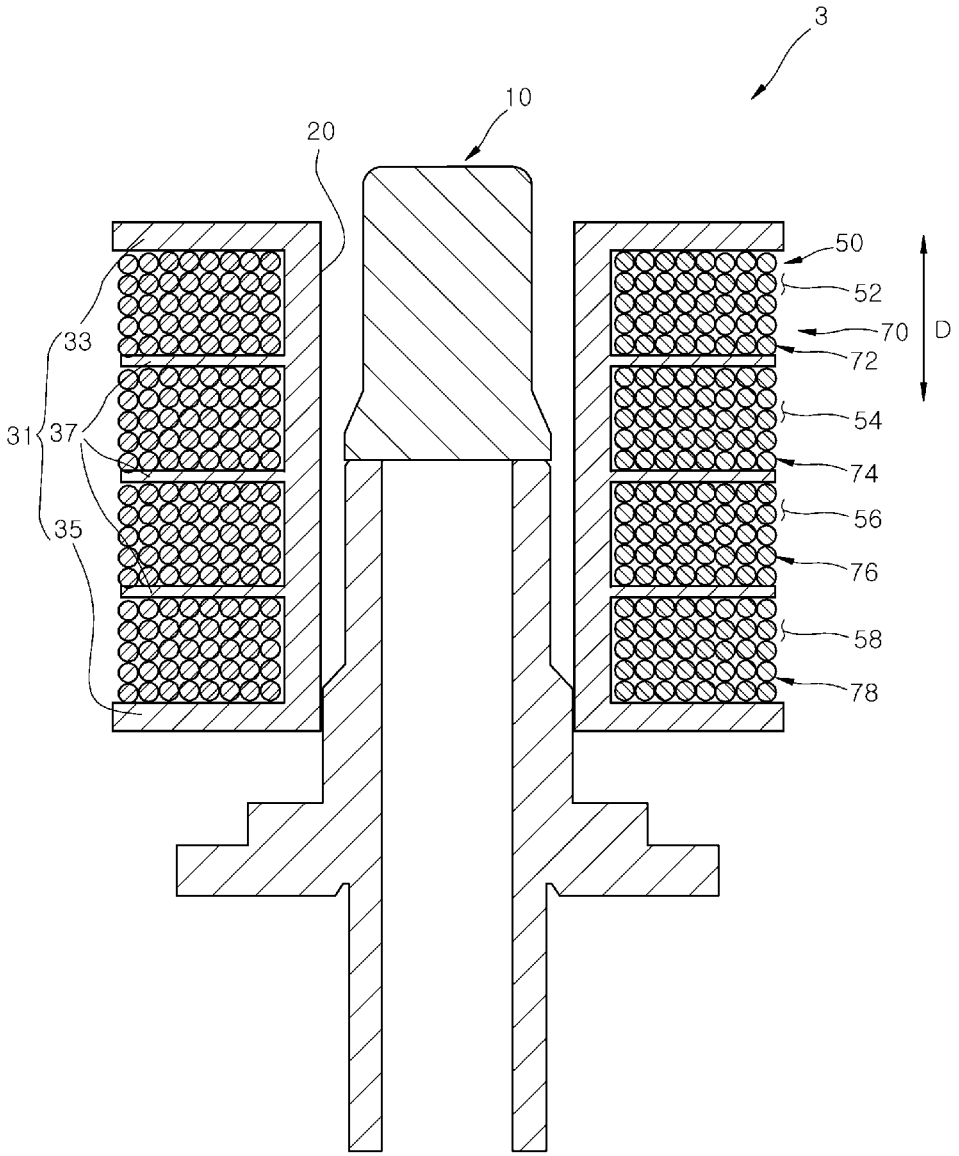
FIG. 5 is a cross-sectional view schematically illustrating the structure of a noise reduction type solenoid valve in accordance with another embodiment of the present invention.
Figure 6:
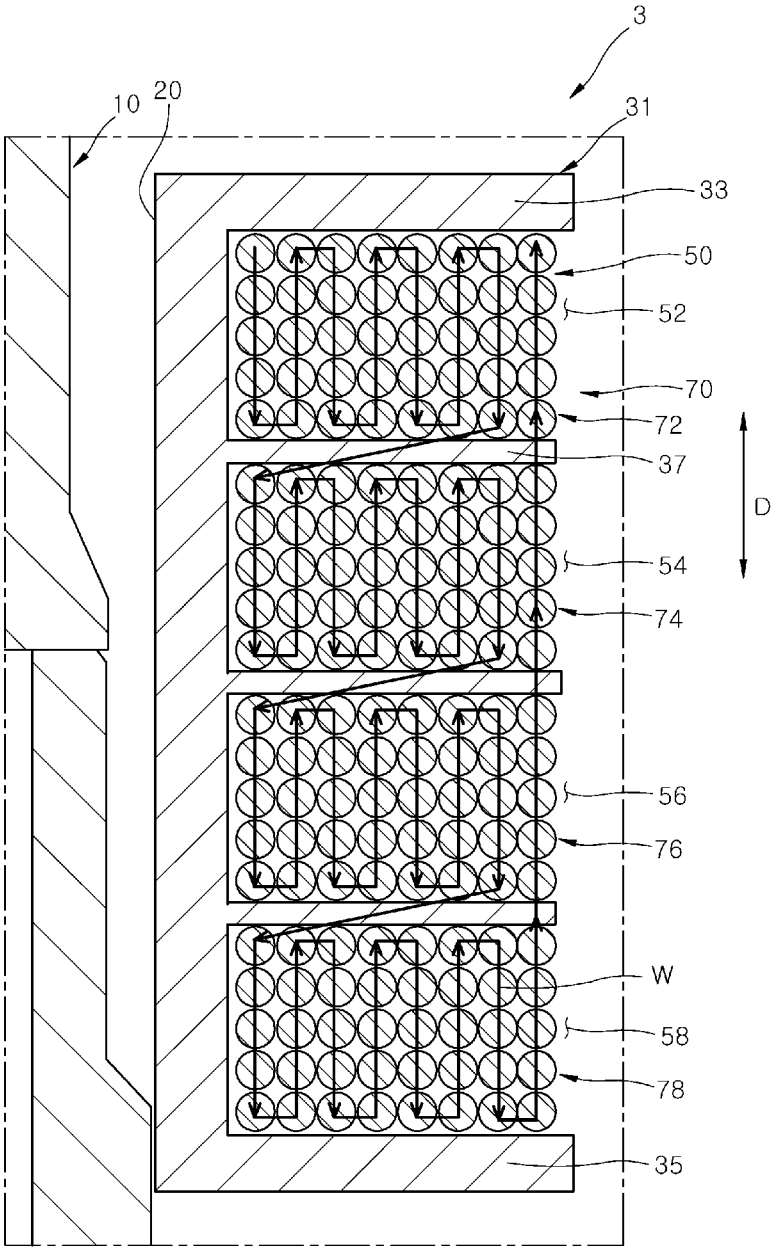
FIG. 6 is a diagram schematically illustrating a flow of electricity passing through a coil part in accordance with the embodiment of the present invention.

FIG. 5 is a cross-sectional view schematically illustrating the structure of a noise reduction type solenoid valve in accordance with another embodiment of the present invention. FIG. 6 is a diagram schematically illustrating a flow of electricity passing through a coil part in accordance with the embodiment of the present invention.

As illustrated in FIGS. 5 and 6, the noise reduction type solenoid valve 3 in accordance with the embodiment of the present invention may include three or more divided spaces 50 formed outside a bobbin 20.

A partition part 31 having dividing partitions formed in a lateral direction outside the bobbin 20 may include a plurality of inner partitions 37 formed between first and second partitions 33 and 35, and separate a winding space of a coil part 70. In the present embodiment, since three inner partitions 37 are positioned between the first and second partitions 33 and 35, the divided spaces 50 formed by the partition part 31 may include a first space 52, a second space 54, a third space 56, and a fourth space 58.

The number of the divided spaces 50 may be set in consideration of productivity, and freely increased/deceased as necessary.

The coil part 70 in accordance with the embodiment of the present invention may include a first coil 72 wound in the first space 52, a second coil 74 wound in the second space 54, a third coil 76 wound in the third space 56, and a fourth coil 78 wound in the fourth space 58.

A winding of the coil part 70 may be started from the inside of the first space 52, and finished at the outside of the first space 52. Then, the winding may be connected to the second space 54, and finished through the same method as the first space 52. Then, a winding may be repeated in the third and fourth spaces 56 and 58.

Since the winding pattern of the coil part 70 wound around the divided spaces 50 has been described in detail in the above-described embodiment, the detailed descriptions thereof are omitted herein.

In accordance with the embodiments of the present invention, the winding of the coil part 60 or 70 may be divided into a plurality of windings by the partition part 30 or 31, and a potential difference of the coil part 60 or 70 in the respective divided spaces 40 or 50 may be reduced. Thus, electromagnetic noise can be reduced. Furthermore, since a separate part for reducing noise is not additionally used unlike the typical solenoid valve, the production cost can be reduced. Furthermore, when the noise reduction type solenoid valve 1 or 3 is installed in a brake system, it is possible to reduce electromagnetic noise transmitted to a driver when a vehicle is braked.

Furthermore, since a separate part such as an anti-vibration damper for reducing noise is not added, the number of parts can be reduced in comparison to the same noise reduction type solenoid valve. Thus, the production cost can be reduced.

Although embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. A solenoid valve comprising:

a bobbin comprising a through-hole elongated along an axis and a circumferential surface;

a plunger comprising an elongated portion extending along the axis and movably arranged within the through-hole;

a partition radially extending from the circumferential surface and partitioning space over the circumferential surface into a first circumferential segment and a second circumferential segment that are arranged in the axis; and windings formed around the circumferential surface comprising a first winding portion and a second winding portion;

the first winding portion comprising a first layer of windings and a second layer of windings formed in the first circumferential segment such that the second layer of windings are stacked over the first layer of windings and that the windings of the first and second layers are serially connected; and the second winding portion comprising a first layer of windings and a second layer of windings formed in the second circumferential segment such that the second layer of windings of the second winding portion are stacked over the first layer of windings of the second winding portion and that the winding of the first and second layers of the second winding portion are serially connected, wherein the windings of the first and second windings portions separated by the partition are serially connected.

2. The noise reduction type solenoid valve of claim 1, further comprising a first wall radially extending from the circumferential surface distanced from the partition along the axis, wherein the first wall and the partition defines the first circumferential segment.

3. The solenoid valve of claim 2, further comprising a second wall radially extending from the circumferential surface distanced from the partition along the axis away from the first wall wherein the second wall and the partition defines the second circumferential segment.

4. The solenoid valve of claim 3, wherein the first winding portion further comprises a third layer of windings stacked over the second layer of windings, wherein the windings of the first, second and third layers of the first winding portion are serially connected.

5. The noise reduction type solenoid valve of claim 3, wherein the partition is formed in a disk shape.

6. The solenoid valve of claim 1, wherein the partition is referred to as a first partition, wherein the solenoid valve further comprises a second partition radially extending from the circumferential surface and distanced from the first partition along the axis, wherein the second partition separates the second circumferential segment from a third circumferential segment that is arranged next to the second circumferential segment in the axis, wherein the windings around the circumferential surface further comprises a third winding portion.

7. The solenoid valve of claim 6, wherein the third winding portion comprising a first layer of windings and a second layer of windings formed in the third circumferential segment such that the second layer of windings of the third winding portion are stacked over the first layer of windings of the third winding portion and that the windings of the first and second layers of the third winding portion are serially connected, wherein the windings of the second and third winding portions are serially connected.

8. The solenoid valve of claim 1, wherein the first winding portion further comprises a third layer of windings stacked over the second layer of windings, wherein the windings of the first, second and third layers of the first winding portion are serially connected, wherein a terminal portion of the third layer of windings is serially connected to a terminal portion of the first layer of windings of the second winding portion.

* * * * *